United States Patent [19]

Taranto

[11] Patent Number: 4,937,984

[45] Date of Patent: Jul. 3, 1990

[54] VACUUM SANDER

[76] Inventor: Thomas F. Taranto, 3396 Patchett Rd., Baldwinsville, N.Y. 13027

[21] Appl. No.: 314,033

[22] Filed: Feb. 23, 1989

[51] Int. Cl.[5] ..... B24D 15/00; B24B 23/00; B24B 55/10

[52] U.S. Cl. ..... 51/392; 51/180; 51/273

[58] Field of Search ..... 51/170 R, 273, 391, 51/392, 393, 180, 170 T, 170 MT, 170TL, 180 R

[56] References Cited

U.S. PATENT DOCUMENTS

| | | | |
|---|---|---|---|
| 1,582,664 | 4/1926 | Bennington | 51/180 |
| 1,972,315 | 7/1931 | Ramey | 51/170 T |
| 2,546,245 | 3/1951 | Weigel | 51/393 |
| 3,638,362 | 2/1972 | Stoll | 51/273 X |
| 4,062,152 | 12/1977 | Mehrer | 51/273 X |
| 4,368,598 | 1/1983 | Kuhlmann | 51/273 X |
| 4,697,389 | 10/1987 | Romine | 51/273 X |
| 4,759,155 | 7/1988 | Shaw | 51/392 |

*Primary Examiner*—Frederick R. Schmidt
*Assistant Examiner*—Bruce P. Watson
*Attorney, Agent, or Firm*—Charles S. McGuire

[57] ABSTRACT

A vacuum sander with the capability of drawing in air and dust that is a byproduct of the sanding process in drywall construction, or other sanding operations. The apparatus is described in both hand-held and handle-held embodiments. The sander comprises a housing with a top wall having front, back and two side walls defining an open bottom and forming a vacuum manifold which communicates with an abrasive sheet at one end and a partial vacuum at the opposite end such that the vacuum manifold is maintained at a reduced pressure. A grid-like support is releasably attached to the manifold open bottom through a plurality of aligned bosses and recesses on opposing walls of the support and housing walls. The grid supports a permeable foam pad which in turn supports the abrasive sheet.

5 Claims, 2 Drawing Sheets

VACUUM SANDER

BACKGROUND OF THE INVENTION

This invention relates to material working tools and more particularly to a sander with vacuum capabilities.

In the construction trades there are many areas of expertise which require a range of specific hand tools to accomplish the desired task. For example, in the area of drywall construction, the tools required may include a saw to cut and a hammer to put up plaster board, a spatula for applying plaster to hammer marks and the tape that covers the joints between the boards, and sanders to smooth the plaster to the dry wall surface.

Sanders may take a variety of forms to aid the workman in his endeavor. Those most commonly used in drywall sanding are manually worked sanders which may be either hand held or have an elongated handle for sanding in high or otherwise inconvenient to reach places. There are also electric sanders to alleviate some of the strain on the user. In any of the procedures used, the problem of the fine sanding dust produced has served as a constant annoyance to the user.

To overcome the problem of the dust, there has emerged a variety of "vacuum sanders" that pick the dust up as it is created by the sanding process. For example, Pat. No. 4,062,152, issued to Mehrer, discloses a drywall sander of the vacuum type that employs a porous abrasive sheet attached directly to a planar support plate in communication with a vacuum manifold through a plurality of bores in the backing plate. This device requires a universal joint and a boot to work the invention with a handle. Besides being complex in design, the Mehrer sander is not designed for use as a hand-held device (without a handle). Furthermore, the backing plate is not porous, having only discrete, spaced openings, nor is it designed for easy assembly with and removal from the manifold. Also, the irregularities encountered in the surfaces being sanded are not dealt with adequately, if at all.

It is therefore a main object of the present invention to provide an improved vacuum sander which is of relatively simple design and easy to use, whether hand-held or mounted at the end of an elongated handle.

Another object is to provide a vacuum sander with an open-grid support releasably attached to and forming one side of an enclosed housing to provide better and faster dust pickup, ease of cleaning, and more economical fabrication.

A further object is to provide a vacuum sander that compensates for irregular surfaces through the use of a foam pad between the rigid support and the abrasive sheet.

Other objects will in part be obvious and will in part appear hereinafter.

SUMMARY OF THE INVENTION

In accordance with the foregoing objects, the present invention contemplates a vacuum sander in embodiments of both the hand-held and handle-held types. In both embodiments, the vacuum sander comprises a housing including a vacuum manifold communicating with a partial vacuum at one end and a porous abrasive sheet at the other end such that the vacuum manifold is maintained at a reduced pressure. The opening to the partial vacuum is via an outward extension of the manifold for easy vacuum hose attachment. The opening to the abrasive sheet is defined by front, rear and side walls forming an open rectangular top of the manifold.

The rigid member providing underlying support for the relatively flexible abrasive sheet is in the form of an open, rectangular gridwork, bounded on four sides by walls which fit within the front, rear and side walls of the manifold. The grid support member is releasably attached to the manifold walls by a snap fit of bosses on the grid support outer walls with recesses in the manifold inner wall surfaces. The front wall of the manifold includes an elongated slot on its outside surface for receiving the front end of the abrasive sheet, the rear wall of the housing receiving the rear end of the abrasive sheet between the grid support and the rear wall of the manifold as the former is snapped into the latter. Between the grid support and the abrasive sheet is a foam pad that is of substantially the same cross dimensions as the grid except that the respective rear end of the foam pad extends slightly past the rear end of the grid support. The abrasive sheet rear end is wrapped around this extension when placed between the grid rear end and the vacuum manifold rear end, and thus "grips" the abrasive sheet for a more secure hold. The foam pad also serves to compensate for irregularities encountered in the surfaces being sanded by providing a resiliently deformable sander surface.

The disclosed embodiment of the sander for holding directly in the user's hand (i.e., without an elongated handle) includes a cylindrical extension on the outer surface of the rear end wall of the vacuum manifold for attachment of a typical vacuum cleaner hose. If the fit is not exact, adaptors may be used. The handle-held embodiment of the invention contemplates the user being positioned a short distance from the wall to reach high places and includes a cylindrical extension on the outer surface of the vacuum manifold top wall. In one form, a flexible hose portion is attached to the extension at one end and a hollow handle portion at the opposite end. At the juncture of the hose portion and handle is a forked attachment for pivoting movement about an axis extending through the manifold housing. In another form, the extension includes a ball and socket joint wherein the ball is rotatably captured in the extension or socket on the manifold top wall. The ball has an open slot communicating with the vacuum manifold on one end and a hollow handle portion on the other end. One end of the hollow handle portion is permanently or slidably received in an opening extending into the ball.

DETAILED DESCRIPTION

Figure 1:
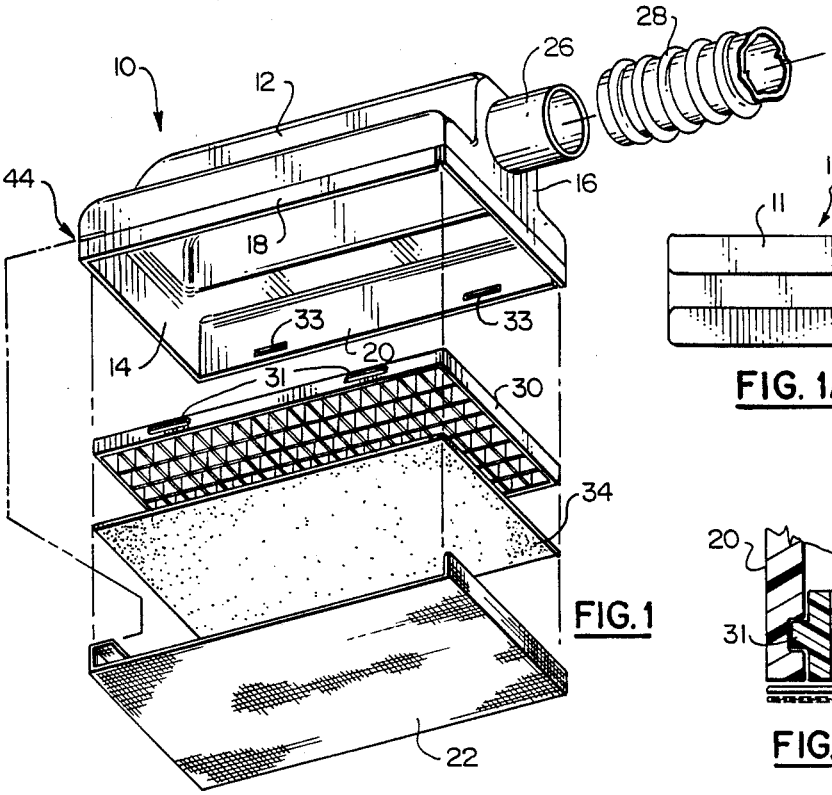
FIG. 1 an exploded, perspective view of the invention in a first embodiment, including a hose attachment.
Figure 1A:
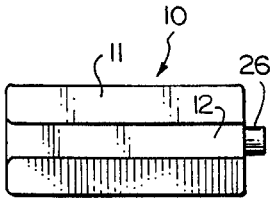
FIG. 1A is a top plan view of the embodiment of FIG. 1.
Figure 2:
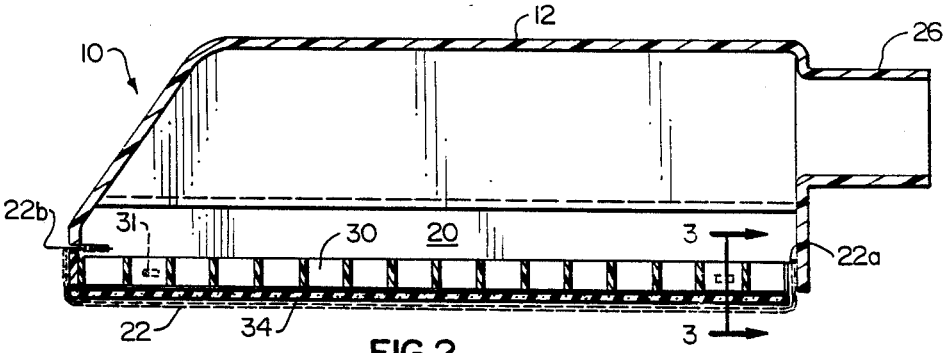
FIG. 2 is a side elevational view of the apparatus of FIG. 1 in verticle section through the center.
Figure 4:
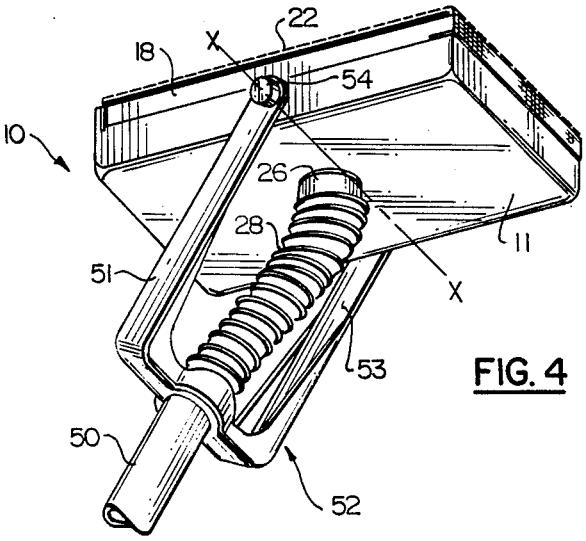
FIG. 4 is a perspective view of a second embodiment of the apparatus.
Figure 6:
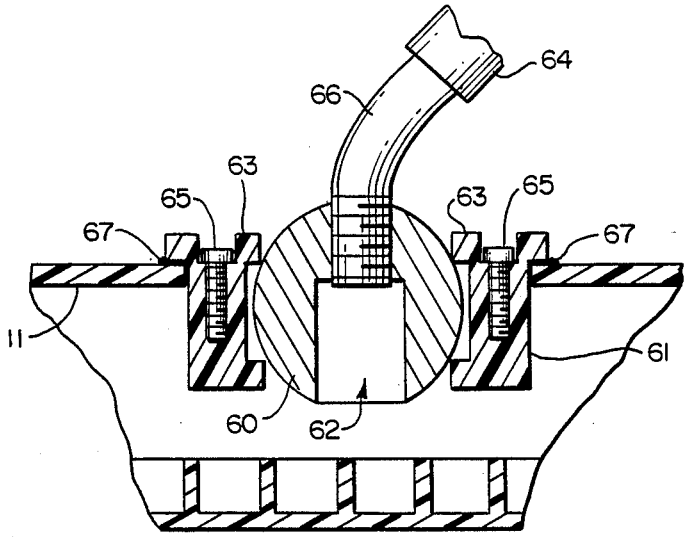
FIG. 6 is an enlarged, fragmentary, elevational view of a portion of the apparatus of FIG. 5, in section.
Figure 5:
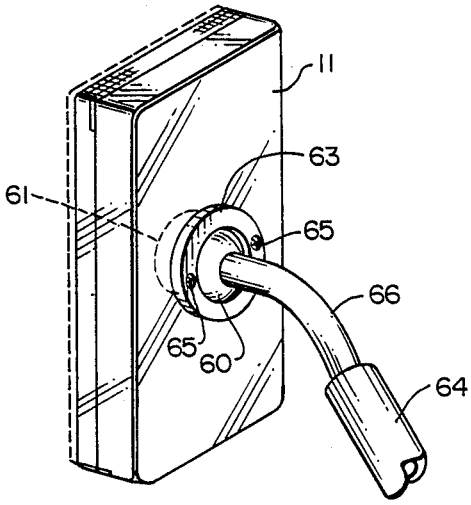
FIG. 5 is a perspective view of an alternate, preferred of the apparatus of FIG. 4.

Referring now to the drawings wherein like reference numerals identify like parts throughout, in FIGS. 1, 1A and 2 is shown a hand-held embodiment of the invention for sanding with the workman close to the surface wall. FIGS. 4, 5 and 6 illustrate other embodiments of the invention contemplating a handle-held device for use in areas such as high walls and ceilings.

The hand-held embodiment of FIGS. 1, 1A and 2 includes housing means denoted generally by reference numeral 10 having a top wall 11 with raised, hollow center strip 12 for ease of gripping the device, shown best in FIGS. 1 and 1A. A front wall 14, back wall 16 and two side walls 18 and 20 extend from top wall 11 to form a vacuum manifold, defining a housing opening of substantially square or rectangular shape. Housing means 10 is formed as a unitary piece of molded plastic, or of aluminum or other sheet metal drawn over a die, with walls 14, 16, 18 and 20 extending outwardly from top wall 11 at slightly more than 90° to provide the necessary draft angle. The outer surface of the back wall 16 includes a cylindrical extension 26 which communicates with the vacuum manifold on one end and a partial vacuum on the other end via a vacuum hose 28 which is included in FIG. 1 to illustrate attachment of the vacuum sander to a vacuum source (not shown) such as an ordinary household or industrial vacuum cleaner.

Figure 3:
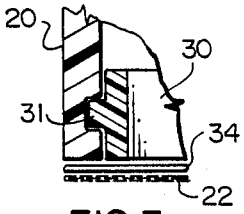
FIG 3 is an enlarged fragmentary view of portions of the apparatus of FIG. 2, taken generally along the line 3—3.

A rigid support member 30 is formed as an open grid of perpendicular wall members, the top and bottom edges of which lie in parallel planes, bounded by front, back and side walls in a configuration fitting closely within the open end of housing 10. The side walls 18 and 20 of housing 10 are somewhat flexible to permit easy attachment and removal of grid support 30 which includes a plurality of bosses 31 on the outer surface of two opposite sides. Bosses 31 align with and "snap" into cooperatively positioned slots 33 on the inner surface of side walls 18 and 20, one such boss and slot being shown in FIG. 3.

Figure 2A:
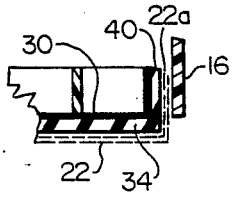
FIG. 2A is an enlarged, fragmentary, side elevational view of a portion of the apparatus of FIG. 2.

An air-permeable, low density, synthetic foam pad 34 is positioned on the planar support provided by the lower wall edges of grid support 30 and extends slightly past the back end of the grid 30, as indicated by reference numeral 40 in FIG. 2A. An abrasive sheet 22 is positioned atop the foam pad 34 and held in place on the sander housing 10 in the back by placing back end **22*a* of sheet 22 between the grid support 30 and the housing back end wall 16 upon attachment of the grid 30 to the housing 10. The wrapping of the abrasive sheet back end 22*a* around the foam pad extension 40 causes the abrasive sheet back end to be "gripped" by the foam pad extension 40, thereby strengthening the hold of the abrasive sheet back end between the grid support 30 and the housing back end wall 16. The front end wall 14 of the housing 10 includes an elongated slot 44 for receiving the front edge 22*b* of the abrasive sheet 22**.

During the operation of the invention, air is drawn through the cylindrical extension 26 by the vacuum source, creating a reduced pressure in the vacuum manifold. As a result, air and dust particles are drawn into the manifold, through foam pad 34 and grid support 30, and out the extension 26, to dust collection means at the vacuum producer. Abrasive sheet 22 may be of the open screen type, as commonly used in drywall sanding operations, or may be a solid sheet since dust pickup will occur at the sides, principally through the edges of foam pad 34.

FIGS. 4, 5 and 6 illustrate alternate handle-held embodiments of the invention wherein cylindrical extension 26 is positioned at the outer surface of the top wall 11 of the housing 10. In FIG. 4 a vacuum hose portion 28 is attached to the cylindrical extension 26 at one end and to a hollow handle 50 at the opposite end. At their juncture, hose 28 and handle 50 extend through an opening in forked member 52, ends 51 and 53 of which are attached to the two side walls 18 and 20 of the housing 10 by bolts 54, forming a lateral axis X—X, about which member 52 may pivot relative to the sander housing 10.

In FIG. 5 is shown an alternate form, providing more universal pivoting movement of the handle relative to the housing. The cylindrical extension 26 is in the form of a socket having lower, cylindrical portion 61, and upper portion 63, secured to portion 61 by screws 65, and to wall 11 by cement 67. Ball 60 is permanently captured between portions 61 and 63 while allowing rotation of the ball 60 within the socket, shown in vertical cross-section in FIG. 6. The ball 60 includes an opening or slot 62, communicating with the vacuum manifold at one end and a hollow handle portion 64 at the opposite end through curved or angled stem portion 66. Stem 66 is engaged by threads or other means to ball 60 at approximately a 45 degree angle to the axis of handle 64, thereby allowing the pivoting of the handle relative to the vacuum manifold while still in communication with the slot 62 and the interior of the manifold. The angle in stem 66 permits the user to stand closer to a wall while sanding; also, it will be noted that ball 60 and portion 61 extend into housing 10, thereby placing the pivot point as close as possible to the surface being sanded. These features assist in ensuring that the housing will slide rather than tending to tip when lateral forces are applied. Rigid handle portion 64 is connected in conventional fashion to vacuum producing means (not shown) at its opposite end. Both the forms of FIG. 4 and FIGS. 5 and 6 of the handle-held embodiment allow the workman to sand high places while standing in relatively close proximity to the vertical surface being sanded at an elevated position. Although particularly useful in drywall sanding operations, the invention may of course be employed in other applications.

What is claimed is:

1. A vacuum sander for attachment to partial vacuum producing means, said sander comprising:

(a) an air permeable abrasive sheet;

(b) a resilient, air permeable pad, one surface of which contacts and support said abrasive sheet;

(c) housing means, having a top wall with side walls extending therefrom to define an open bottom, forming a vacuum manifold;

(d) attachment means on an outer surface of at least one of said top and side walls communicating with said vacuum manifold on one end and with said partial vacuum producing means on the opposite end such that said vacuum manifold is maintained at a sub-atmospheric pressure;

(e) an open, grid-like support member of substantially the same lateral dimensions as, and positioned within said open bottom, said support member comprising peripheral walls opposing said housing side walls and defining the boundaries of a plurality of intersecting, spaced, wall members having bottom edge portions lying in a common plane substantially perpendicular to said support member peripheral walls and coplanar with the bottom edges of said support member peripheral walls and said housing side walls, said bottom edge portions providing a rigid support for said pad and said abrasive sheet; and (f) means securing said abrasive sheet and said pad in covering relation to said rigid support with the surface of said pad opposite said one surface contacting said rigid support, whereby air and sanding residue are drawn into said vacuum manifold through said pad, said support member and said abrasive sheet.

2. The invention according to claim 1 and further comprising releasable engagement means for attaching and removing said grid-like support member within said open bottom of said housing means.

3. The invention according to claim 2 wherein said engagement means comprises a plurality of aligned recesses and bosses on said housing side walls and said support member peripheral walls, said bosses snapping into said recesses upon placement of said support member into said open bottom, thereby securing said support member to said housing means.

4. The invention according to claim 1 wherein at least one end of said resilient, pad and a respective end of said abrasive sheet extend past said support member a distance sufficient to be frictionally held between at least one en dof said pad urges said respective abrasive sheet end against said at least one of said housing means side walls, thereby reinforcing the placement and hold of said abrasive sheet to said support member and said housing means.

5. The invention according to claim 1 wherein said vacuum sander is of the handle-held type, and said attachment means comprises a cylindrical portion extending outwardly from the outer surface of said housing means top wall in a central position and further including:

(a) an elongated, rigid, hollow handle communicating at one end with said vacuum manifold through said cylinder portion and at the other end with said partial vacuum producing means;

(b) a ball and socket joint within said cylindrical portion;

(c) a hollow stem having first and second portions connected to said ball and said one end of said handle respectively, said first and second portions lying along axes disposed at an acute angle; and (d) a passageway in said ball through which said handle communicates with said vacuum manifold.

* * * * *